United States Patent [19]

McCullough

[11] 4,395,205

[45] Jul. 26, 1983

[54] MECHANICALLY ACTUATED TIP SEALS FOR SCROLL APPARATUS AND SCROLL APPARATUS EMBODYING THE SAME

[75] Inventor: John E. McCullough, Carlisle, Mass.

[73] Assignee: Arthur D. Little, Inc., Cambridge, Mass.

[21] Appl. No.: 233,915

[22] Filed: Feb. 12, 1981

[51] Int. Cl.[3] ..... F01C 19/08; F16F 1/08; F16J 15/16; B23P 15/00

[52] U.S. Cl. ..... 418/55; 418/142; 418/144; 29/156.4 R; 29/173; 29/452; 267/156; 277/204; 277/236

[58] Field of Search ..... 418/55, 57, 142, 144; 277/102, 114, 203, 204, 236; 267/59, 156, 161, 162; 29/156.4 R, 173, 446, 452

[56] References Cited

U.S. PATENT DOCUMENTS

| | | | |
|---|---|---|---|
| 3,180,563 | 4/1965 | Jones et al. | 418/142 |
| 3,942,808 | 3/1976 | Gross | 277/236 |
| 3,994,636 | 11/1976 | McCullough et al. | 418/55 |
| 4,065,279 | 12/1977 | McCullough | 418/55 |
| 4,080,120 | 3/1978 | Eiermann | 418/142 |
| 4,199,308 | 4/1980 | McCullough | 418/55 |

*Primary Examiner*—John J. Vrablik
*Attorney, Agent, or Firm*—Richard J. Hammond

[57] ABSTRACT

Axial compliance/sealing means are provided for scroll-type apparatus. These means comprise seal elements capable of experiencing axial and radial motion within channels cut in the tips of the involute wraps to make sealing contact with the end plates of the opposing scroll members. Continuous involute spring members having a pitch larger than the wrap involute channel provide a mechanical force applying means to urge the seal elements into sealing contact. The use of the axial compliance/sealing means allows the contacting surfaces through which radial sealing is effected to be machined to conventional accuracy, and provides automatic compensation for temperature differentials within the apparatus as well for any uneven wear of the scroll members. The sealing means is particularly suited for reliable extended operation in a hermetically sealed apparatus.

13 Claims, 13 Drawing Figures

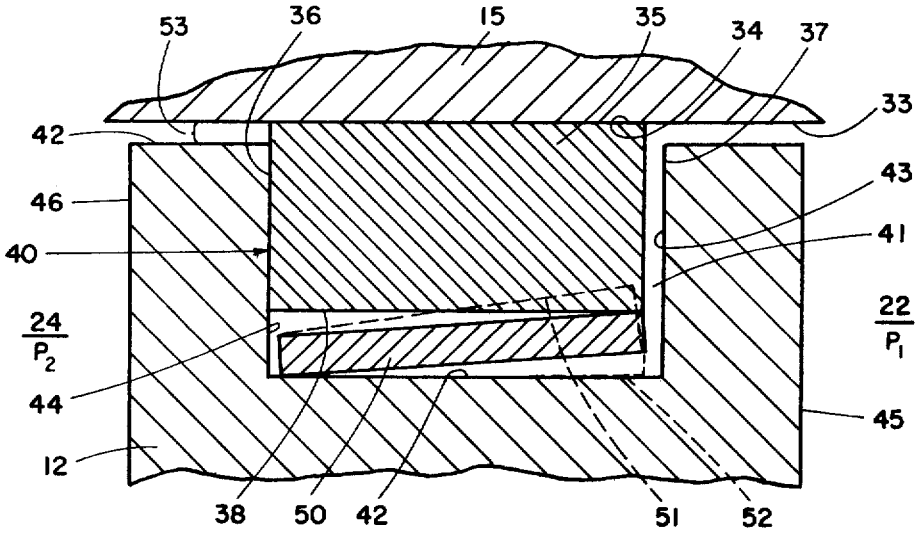
Fig. 3
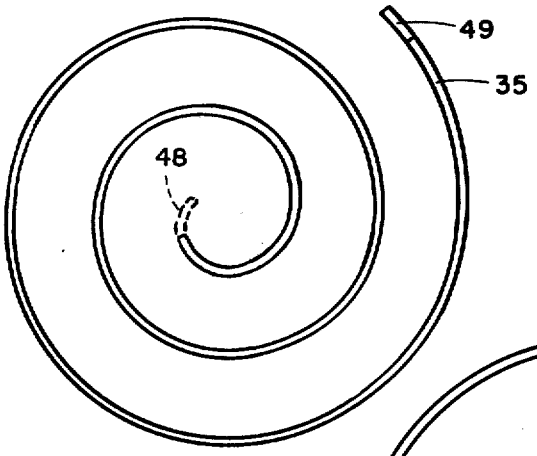
Fig. 4
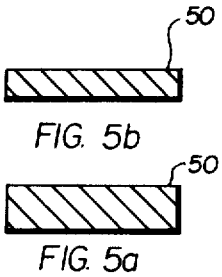
FIG. 5b
FIG. 5a
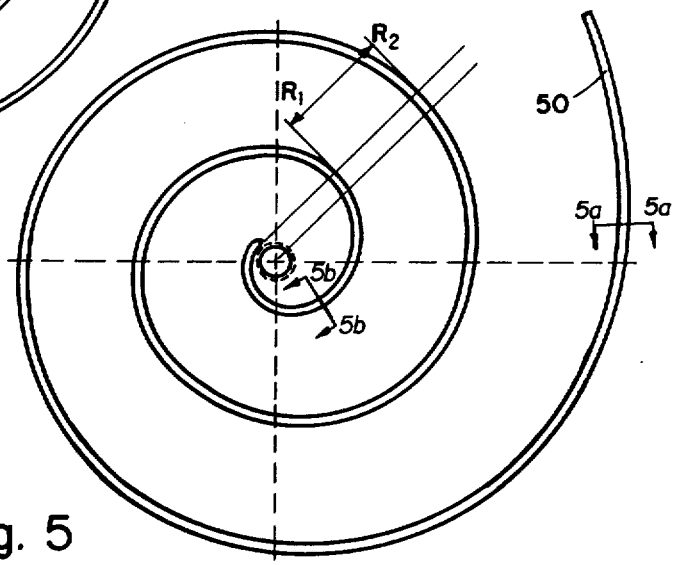
Fig. 5
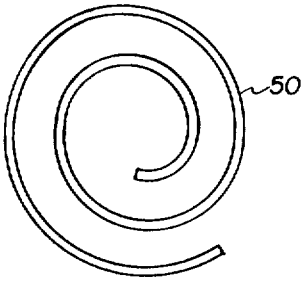
FIG. 5c

MECHANICALLY ACTUATED TIP SEALS FOR SCROLL APPARATUS AND SCROLL APPARATUS EMBODYING THE SAME

This invention relates to scroll-type apparatus and more particularly to scroll-type apparatus having axial and radial compliance/sealing means which materially reduce the problems of constructing the scroll-type apparatus and which enhance its extended operation.

There is known in the art a class of devices generally referred to as "scroll" pumps, compressors and expanders wherein two interfitting spiroidal or involute spiral elements of like pitch are mounted on separate end plates. These spiral elements are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls and comprises one or more fluid pockets, the angular position of which varies with relative orbiting of the spiral centers. All of these pockets maintain the same relative angular position; and as the contact lines shift along the scroll surfaces, the pockets experience a change in volume. The resulting zones of lowest and highest pressures are connected to fluid ports.

Although the concept of a scroll-type apparatus has been known for some time and has been recognized as having some distinct advantages, the scroll-type apparatus of the early prior art has not been commercially successful, primarily because of sealing and wearing problems which have placed severe limitations on the efficiencies, operating life, and pressure ratios attainable. Such sealing and wearing problems are of both radial and tangential types. Thus, effective axial contacting must be realized between the ends of the involute spiral elements and the end plate surfaces of the scroll members which they contact to seal against radial leakage and achieve effective radial sealing; and in some types of scroll apparatus effective radial contacting with minimum wear must be attained along the moving line contacts made between the involute spiral elements to seal against tangential leakage.

Early approaches to the attainment of acceptable radial sealing in prior art apparatus included machining the components (wraps and end plates) to accurate shapes for fitting with very small tolerances and using one or more mechanical axial constraints, e.g., bolts to force the surfaces into contact; the use of a compliant fixed scroll member (U.S. Pat. No. 3,874,827); the use of a pressurized fluid (with or without springs to provide an augmenting axial force) to urge the scroll members into axial contact (U.S. Pat. Nos. 3,600,114, 3,817,664, 3,884,599 and 3,924,977); or the use of improved radial sealing means in which all of the forces required to achieve efficient axial load carrying are pneumatic forces provided by pressurizing all or a selected portion of the apparatus housing. However, the use of these techniques still requires very accurate machining of both the contacting surfaces, i.e., the surfces of the end plates and the surfaces of the involute spiral wrap members. This requirement of accurate machining adds materially to the cost of the scroll-type apparatus manufacture. Moreover, any axial misalignment in the apparatus during operating will generally result in uneven wear, thus defeating the attainment of the accurate machining.

Finally, radial temperature gradients within the apparatus give rise to uneven dimensional changes in the height of the involute wraps.

In U.S. Pat. No. 3,994,636 there is disclosed sealing means which permits the contacting surfaces to be machined only to conventional accuracy to attain acceptable axial contacting and hence efficient radial sealing. In this sealing means, a three-sided channel is cut in the tip surface of each of the wraps and it is formed to follow the configuration of the warp. Within each channel is placed a compliance/sealing means through which the axial contact is effected. Each of the compliance/sealing means comprises in combination a seal element seated in the channel and of the same involute configuration as the channel and force applying means which may be pneumatic or mechanical, for acutating the seal element to effect the required axial contact. The width of the seal element is less than the width of the channel to permit the seal element to experience small radial and axial excursions within the channel; and the seal element has a contacting surface width which is less than the width of the wrap.

In U.S. Pat. No. 4,199,306 there is disclosed an improvement of the sealing means of U.S. Pat. No. 3,994,636 in which the involute wrap of the stationary and orbiting scroll members have two-sided channels cut along essentially the lengths of the surfaces of the wraps. Each of the channels has its opening toward the centerline of the scroll elements and it is defined by a back surface and a seating surface. A seal element, suitable for making sealing contact with the surface of an end plate of a complementary scroll member, is positioned in the channel, it is compressively loaded toward the sealed surface, outside the channel, and its extends throughout essentially the entire length of the channel. A seal spring means formed as a continuous strip engageable with the back surface of the channel and having a plurality of spring members configured to exert an axial force on the seal element in the direction of the end plate of the complementary scroll member serves as the mechanical force applying means to actuate the seal element. The teachings of U.S. Pat. No. 3,994,636 and 4,199,306 are incorporated herein by reference.

The use of an involute seal element sized and positioned to be able to experience small axial and radial excursions in a three-sided involute channel cut in the contacting surfaces of the scroll member wraps has provided the degree of radial sealing required to construct efficient scroll apparatus. As pointed out in U.S. Pat. No. 3,994,636, some force applying means (pneumatic or mechanical) is necessary to actuate the seal element. Among the mechanical force applying means shown in that patent are an elastomeric member 65 (FIG. 7), spaced springs 62 in compression positioned in separate, spaced spring wells 61 (FIG. 5), or relatively complex configurations of a spring seal such as 70 (FIG. 9) or 74 (FIG. 10). The least expensive and easiest to install of these mechanical force applying means is the elastomeric member. However, for some types of scroll apparatus, elastomeric members are not satisfactory, for they do not maintain their spring properties in some services and under some environments. For example, elastomeric members will deteriorate in scroll apparatus handling Freon ® refrigerants in which oil circulates in the refrigerant. Since many hermetically sealed refrigeration apparatus in which such conditions prevail must be capable of operating for lifetimes of 15 years or so, it is apparent that elastomeric members can not be used. It would therefore be desirable to have a mechanical force applying means which was as simple and inexpensive to make and install as an elastomeric member but which was capable of effective operation over an extended period of time.

U.S. Pat. No. 4,199,306 discloses a two-sided channel cut in the contacting surfaces of the scroll member wraps and mechanical force applying means in the form of seal spring means formed as a continuous strip engageable with the back surface of the channel and of a plurality of spring members engageable with the bottom surface of the channel to exert an axial force on the seal alement. Although such force applying means may be formed of materials which are not subject to deterioration over extended periods, these means are relatively costly to manufacture and they are applicable only to wraps having two-sided channels.

It is therefore a primary object of this invention to provide an improved axial compliance/sealing means for achieving radial sealing of scroll-type apparatus. It is another object to provide sealing means of the character described having an actuating member for the sealing means which is inexpensive to make and to install and which is capable of operating effectively over an extened period of time, e.g., for a number of years without replacement. Yet another object is to provide axial compliance/sealing means capable of extended periods of time in environments which would be deteriorative to some other types of simple, inexpensive mechanical actuating means such as elastomeric members. An additional object is to provide sealing means of the character described in which the involute channel in which the seal member is located may have two or three sides.

It is another primary object of this invention to provide improved scroll-type apparatus wherein effective radial sealing is achieved through the use of axial compliance/sealing means having mechanical force applying means which are not only simple and inexpensive to make and install but are also capable of functioning efficiently in essentially all environments, including those in which a refrigerant containing oil is circulated. It is a further object of this invention to provide scroll-type apparatus of the character described which incorporate axial compliance/sealing means to effect efficient radial sealing during prolonged operation even though some radial temperature gradients are experienced within the apparatus and uneven wear of the contacting surfaces, through which radial sealing is attained, is brought about. A further object of this invention is to provide axial compliance/sealing means of the character described which may be used with a lubricant or which may be adapted for apparatus which must operate without lubricants.

It is an additional primary object of this invention to provide scroll-type apparatus including compressors, expansion engines and pumps which may be constructed at costs somewhat less than heretofore possible.

Other objects of the invention will in part be obvious and will in part be apparent hereinafter.

The invention accordingly comprises the features of construction, combinations of elements, and arrangement of parts which will be exemplified in the constructions hereinafter set forth, and the scope of the invention will be indicated in the claims.

According to one aspect of this invention there is provided a scroll member suitable for constructing a scroll apparatus, comprising in combination an end plate; an involute wrap attached to the end plate and having a channel cut along essentially the length of the tip of the wrap and having an involute configuration of the same pitch as the wrap; a seal element positioned in the channel, extending throughout essentially the entire length thereof, the seal element being suitable for making sealing contact with the surface of an end plate of a complementary scroll member forming part of the scroll apparatus; and mechanical seal element actuating means to exert an axial force on the seal element in the direction of the end plate of the complementary scroll member; the actuating means comprising at least one involute spring member having a width less than that of the channel and a pitch greater than that of the channel such that when it is forced to seat in said channel it is coned to raise one edge higher than the other and exert a force on the seal element to make the sealing contact.

According to another aspect of this invention there is provided a positive fluid displacement apparatus, comprising in combination a stationary scroll member having a stationary end plate and a stationary involute wrap, the wrap having a channel cut along essentially the length of its contacting end surface, and having an involute configuration of the same pitch as the wrap; an orbiting scroll member having a orbiting end plate and an orbiting involute wrap, the wrap having a channel cut along essentially the length of its contacting end surface, and having an involute configuration of the same pitch as the wrap; driving means for orbiting the orbiting scroll member relative to the stationary scroll member while maintaining the scroll members in a predetermined fixed angular relationship, whereby the stationary and the orbiting involute wraps define moving fluid pockets of variable volume and zones of different fluid pressure; means for providing an axial force to urge the stationary involute wrap into axial contact with the orbiting end plate and the orbiting involute wrap into axial contact with the stationary end plate thereby to achieve radial sealing of the pockets; and compliance/sealing means associated with each of the involute wraps, each compliance/sealing means comprising, in combination, a seal element positioned in the channel extending throughout essentially the entire length thereof, the seal element being suitable for making sealing contact with the surface of the end plate of the complementary scroll member forming part of the apparatus; and mechanical seal element actuating means to exert an axial force on the seal element in the direction of the end plate of the complementary scroll member, the actuating means comprising at least one involute spring member having a width less than that of the channel and a pitch greater than that of the channel such that when it is forced to seat in the channel it is coned to raise one edge higher than the other and exert a force on the seal element to make the sealing contact.

According to yet another aspect of this invention there is provided a positive fluid displacement apparatus into which fluid is introduced through an inlet port for circulation therethrough and subsequently withdrawn through a discharge port, and comprising a stationary scroll member having an end plate and an involute wrap and an orbiting scroll member having an end plate and an involute wrap, driving means for orbiting the orbiting scroll member with respect to the stationary scroll member whereby the involute wraps seal off and define pockets of variable volume and zones of different fluid pressure, means to maintain the scroll members in fixed angular relationship, means for providing an axial force to urge the involute wrap of the stationary scroll member into axial contact with the end plate of the orbiting scroll member and the involute wrap of the orbiting scroll member into axial contact with the end plate of the stationary scroll member thereby to achieve radial sealing of the pockets, the improvement comprising axial compliance/sealing means associated with each of the involute wraps and each comprising, in combination a channel cut along essentially the length of the contacting surface of each of the wraps and having an involute configuration of the same pitch as the wrap; a seal element positioned in the channel, extending throughout essentially the entire length thereof, the seal element being suitable for making sealing contact with the surface of an end plate of a complementary scroll member forming part of the scroll apparatus; and mechanical seal element actuating means to exert an axial force on the seal element in the direction of the end plate of the complementary scroll member, the actuating means comprising at least one involute spring member having a width less than that of the channel and a pitch greater than that of the channel such that when it is forced to seat in the channel it is coned to raise one edge higher than the other and exert a force on said seal element to make the sealing contact.

For a fuller understanding of the nature and objects of the invention, reference should be had to the following detailed description taken in connection with the accompanying drawings in which FIG. 1 is a partial cross section of the stationary and orbiting scroll members of a typical scroll apparatus taken through the machine axis and showing the general location of the axial compliance/sealing means of this invention;

FIG. 3 is a much enlarged detailed cross section of one embodiment of the axial compliance/sealing means using the mechanical force applying means of this invention positioned in the wrap of a scroll member;

FIG. 4 is a top planar view of a preferred embodiment of the seal element of the sealing means of this invention;

FIG. 5 is a top planar view of the force applying means of this invention showing the larger pitch of the involute relative to that of the involute wrap of FIG. 2;

FIGS. 5A and 5B are sectional views taken along lines *5a*—*5a* and *5b*—*5b*, respectively, in FIG. 5;

FIG. 5C shows an alternative embodiment of the spring shown in FIG. 5;

Figure 1:
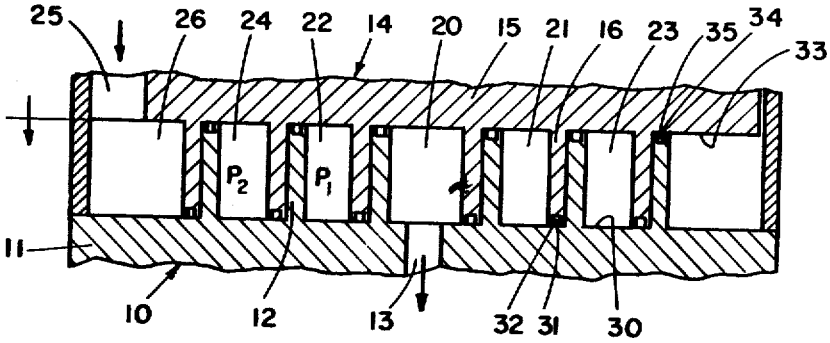

Inasmuch as radial sealing within scroll-type apparatus is an essential feature of such apparatus and since any axial contacting means must be capable of attaining radial sealing, it will be helpful, before describing the axial compliance/sealing means of this invention to briefly review the problems of radial sealing to understand the role which the axial compliance/sealing means of this invention must play in effectively sealing off the pockets within the apparatus to obtain efficient operation over extended periods of time with little or no maintenance. Since the principles of the operation of scroll apparatus have been presented in a number of previously issued patents, it is unnecessary to repeat a detailed description of the operation of such apparatus in discussing the problems faced in attaining effective radial sealing. It is only necessary to point out that a scroll type apparatus operates by moving sealed pockets of fluid from one region into another region which may be at a different pressure. The sealed pockets of fluid are bounded by two parallel planes defined by end plates, and by two cylindrical surfaces, i.e., wraps, defined by the involute of a circle or other suitably curved configuration. The scroll members have parallel axes since in only this way can be continuous sealing contact between the plane surface of the scroll members be maintained. Movement of the pockets defined between the parallel surfaces of the end plates is effected as one cylindrical surface (flank of the wrap of the orbiting scroll member) is orbited relative to the other cylindrical surface (flank of the wrap of the stationary scroll member). In the case of compressors and expanders, the pressures in the moving pockets decrease radially outward, a fact which means that there is a pressure differntial from one pocket to its radially adjacent pocket which makes it necessary to provide a sealing contact between the wrap end contacting surface and the end plate surface of the complementary or opposing scroll member to prevent fluid leakage from the higher- to the lower-pressure pockets. Thus, it will be seen that it requires some form of axial loading to ensure contact between the wrap end surface and end plates to achieve radial sealing.

In the design and construction of scroll-type apparatus tangential sealing may also be important. Tangential sealing may be achieved through maintaining line contact between the wrap flanks as the orbiting scroll member is moved. Since tangential and radial sealing are usually, but not always, attained through separate mechanisms, the axial compliance/sealing means of this invention may be employed in scroll type apparatus using different tangential sealing techniques. The axial compliance/sealing means may also, however, be used in those scroll-type apparatus wherein a small clearance is maintained between the flanks of the wraps to minimize wear and in liquid pumps wherein tangential sealing is of lesser importance than in a compressor, for example. Thus, the axial compliance/sealing means of this invention are equally applicable to the scroll apparatus of U.S. Pat. Nos. 3,884,599, 3,924,977, 3,994,633, 3,994,635, 4,065,279, and 4,082,484 and to the scroll apparatus incorporating a peripheral drive as described in U.S. Pat. No. 4,192,152 as well as to the scroll liquid pumps described in U.S. Pat. Nos. 4,129,405 and 4,160,629.

Figure 2:
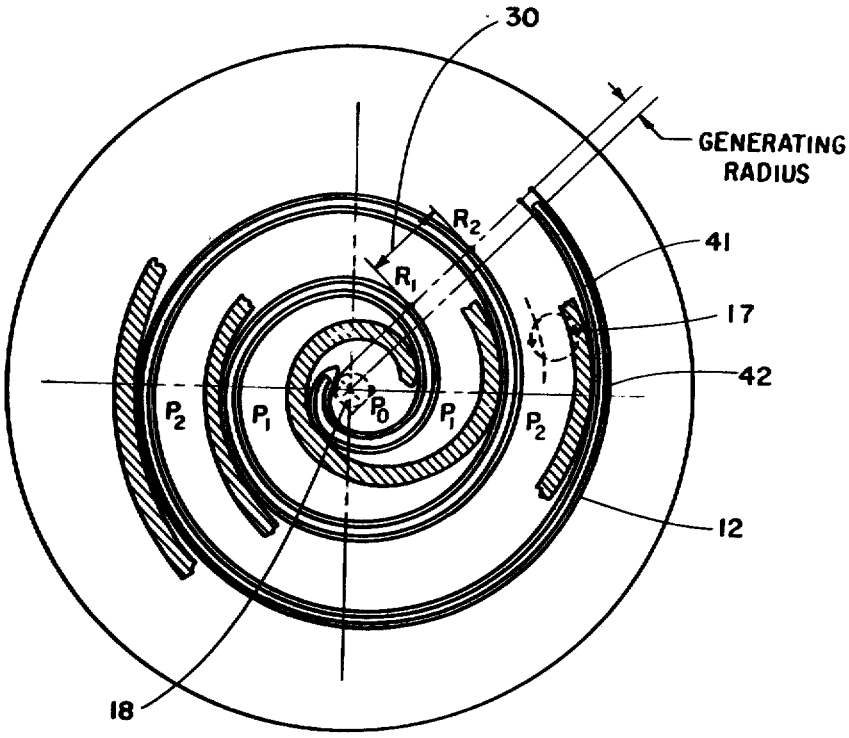
FIG. 2 is a partial cross section of the scroll apparatus of FIG. 1 taken through plane 2—2 of FIG. 1 and including notations illustrating the meaning of involute pitch.
Figure 10:
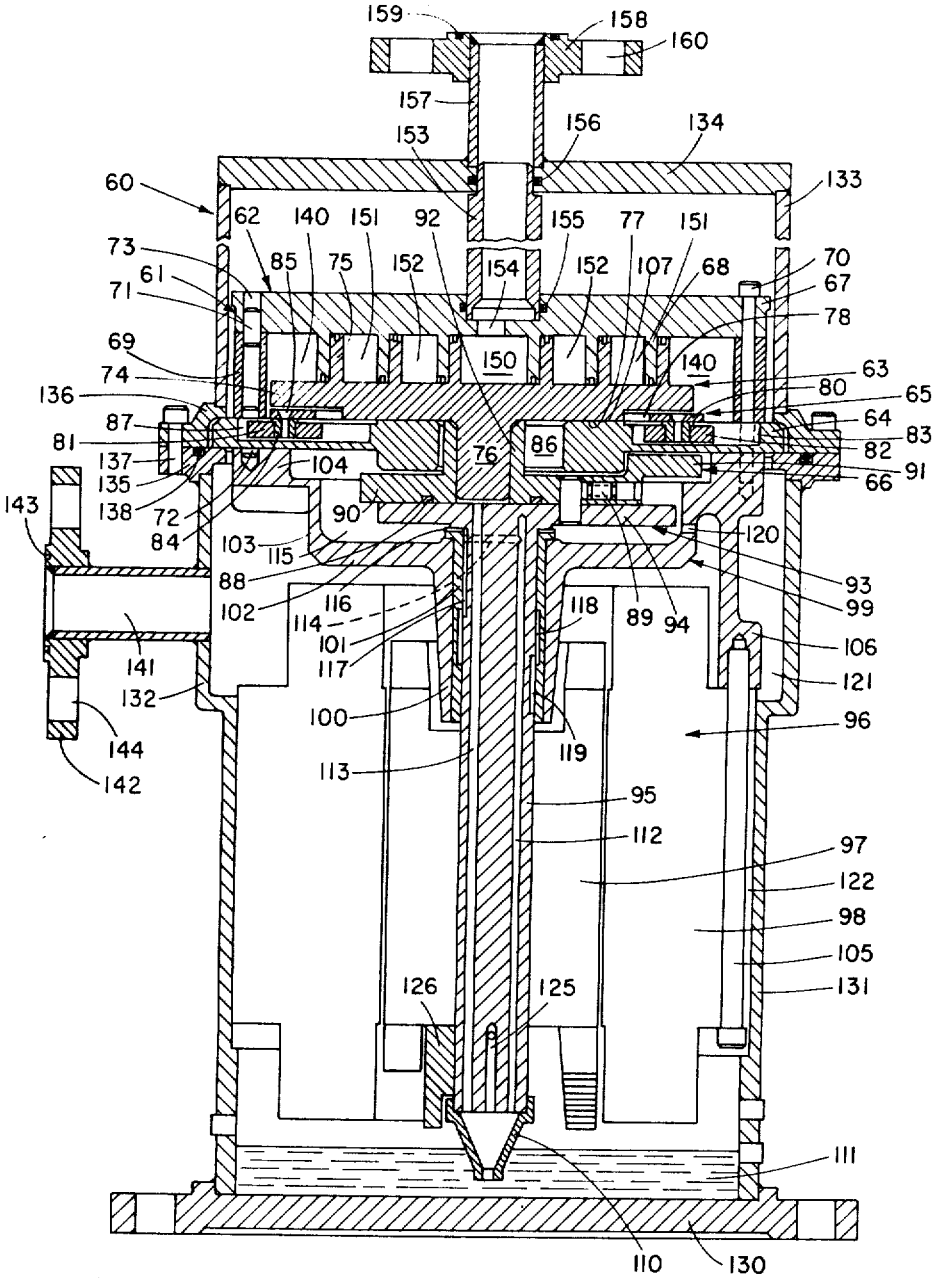
FIG. 10 is a longitudinal cross section of a scroll compressor incorporating the axial compliance/sealing means of this invention.

FIGS. 1 and 2 are presented to further illustrate the problem of providing radial sealing with compliance without the need for the extremely accurate machining of contacting surfaces. The cross sectional views of FIGS. 1 and 2 show only portions of end plates, wrap members and fluid pockets. A complete exemplary scroll-type apparatus embodying the sealing/compliance means of this invention is shown in FIG. 10 and is described in detail below.

In FIGS. 1 and 2, the stationary scroll member 10 is seen to comprise an end plate 11 and a wrap 12. End plate 11 has a centrally located fluid port 13. For convenience in discussing the compliance/sealing means of this invention and the scroll-type apparatus in which these means are incorporated, the apparatus will hereinafter be asssumed to be a compressor. However, it will be apparent to those skilled in the art that the compliance/sealing means are equally applicable to scrolltype apparatus used as expansion engines or as pumps.

In FIGS. 1 and 2 the orbiting scroll member 14 is likewise formed of an end plate 15 and an involute wrap 16. In practice, the orbiting scroll member may be attached to a drive shaft (not shown) or caused to orbit through the use of a suitable peripheral drive mechanism. In operation, the orbiting scroll member 15 is driven to describe an orbit 17 (FIG. 2) while the two scroll members are maintained in a fixed angular relationship. In its orbiting motion, the orbiting scroll member defines one or more moving fluid pockets, i.e., pockets 20-24 in which $P_0 > P_1 > P_2$ (FIG. 2). These pockets may be bounded radially by sliding or moving line contacts between wraps 12 and 16; or for some applications a small clearance may be maintained between the flank wraps (see for example U.S. Pat. No. 4,082,484). The fluid is taken through inlet line 25 into the peripheral zone 26 surrounding the wraps and from zone 26 it is introduced into the pockets and compressed as the pockets become smaller in volume as they approach the central pocket 20. Thus, only through effective radial sealing can the desired fluid pressures in the various moving pockets be maintained.

The involute wraps 12 and 16 have the same pitch which, as shown in FIG. 2, is defined as the numerical difference, represented by arrow 30, in the radii (e.g., $R_1$ and $R_2$) of consecutive turns of the outer (or inner) wrap flank walls. These radii are lines drawn tangent to the generating radius.

In the apparatus of this invention, radial sealing is achieved through a primary and a secondary sealing surface. The primary sealing surface involves the contact of the surface 30 of stationary end plate 11 by the surface 31 of a seal element 32 seated in orbiting wrap 16 and axially forced against surface 30; and through the contact of the surface 33 of orbiting end plate 15 by the surface 34 of a seal element 35 seated in stationary wrap 12 and axially forced against surface 33. The secondary sealing surface involves (as described below in conjunction with FIG. 3) the contact of the seal element with that channel side wall nearest to the wrap flank wall exposed to the lower pressure pocket. It will be appreciated that in FIG. 1, which is presented only for the purpose of discussing the general concept of radial sealing, the details of the axial compliance/-sealing means of this invention are not shown.

FIG. 3 is a cross section through the axial compliance/sealing means of this invention generally indicated by the numeral 40, associated with the wrap 12 of the stationary scroll member 10 and forming sealing contact with surface 33 of orbiting end plate 15. Since this sealing means is continuous along essentially the entire length of the wrap and since the construction of the sealing means associated with the involute wrap 16 of the orbiting scroll member 14 is identical to that shown in FIG. 3, this figure may be used to illustrate the axial compliance/sealing means for both scroll members.

As noted previously, the primary sealing surface involves the sealing contact made between surface 34 of seal element 35 and end plate surface 33. Seal element 35 which has, in addition to end plate contacting surface 34, side surfaces 36 and 37 and force applying surface 38, is set in a channel 41 cut in the end surface 42 of wrap 12. Channel 41 is defined by a bottom surface 42, and side surfaces 43 and 44. Side surface 43 is nearest wrap flank wall 45 which is exposed to the higher pressure pocket 22 and side surface 44 is nearest wrap flank wall 46 exposed to the lower pressure pocket 24. Thus in the preferred situation in which the maximum sealing of pocket 22 from pocket 24 is achieved, it is necessary to attain sealing contact between side walls 44 and seal element surface 36. As noted above, this contact of the sides of the channel and of the seal element nearest the lower pressure pocket constitutes a secondary sealing contact. A preferred technique for effecting this secondary sealing contact is described below.

As will be seen from FIG. 2, channel 41 is cut in surface 42 of wrap 12 along essentially its entire length, stopping short of the inner and outer ends, and it has the same involute configuration, i.e., the same pitch as the involute wrap. Likewise, seal element 35 has the same configuration as wrap 12 and channel 41 (FIG. 4); but it is somewhat narrower than the channel and its thickness is less than the depth of channel 41 to allow it to experience both small axial and radial excursions in the channel. In a preferred embodiment, seal element 35 is cut off at its inner end so that it is slightly shorter than channel 41, as indicated by the dotted section 48 of channel 41, and slightly longer at its outer end as shown by section 49. Seal element 35 has a rectangular cross section and is preferably formed of a metallic material such as cast iron or chrome-plated steel.

In accordance with prior art teachings (U.S. Pat. Nos. 3,994,636 and 4,199,306) seal element 35 is forced into sealing contact with the surface 33 of the end plate of the complementary scroll member by the mechanical force applying means 50 which is, in accordance with this invention, an involute spring member having a pitch greater than the pitch of involute channel 41 as shown in FIG. 5. When the higher pitch involute spring member 50 is seated in the lower pitch involute channel 41 it takes on a conical configuration or becomes coned such that one edge of the involute rises above the other. Dotted line 51 in FIG. 3 shows the free height of the involute 50 within channel 41 and dotted line 52 shows what may be termed the "solid position" of the involute. The involute seated in channel 41 therefore becomes a continuous spring member, along the entire length of the channel, which is capable of exerting an axial force along the entire length of element 35 to achieve the desired primary seal between surfaces 33 and 34. As illustrated in FIG. 3, the primary sealing is attained so that there exists a tip seal clearance 53 between the surface 42 of wrap 12 and surface 33 of the end plate of the complementary scroll member. Ideally, tip seal clearance 53 is minimal, being only sufficient to prevent any actual contact between surfaces 33 and 42. As an example, clearances of about 5 mils (about 0.013 cm) are sufficient to allow for any surface imperfections resulting from machining the scroll member elements.

Involute member 50 is formed of a metal having a high yield stress, e.g., a spring material such as spring steel or spring phosphor bronze; and it is conveniently formed by blanking it out of suitable sheet or flat plate material. The width of involute 50 is slightly less than that of channel 41, and its thickness is normally of the order of about 10 mils (about 0.025 cm). The pitch of involute 50 is generally from about 10% to about 20% greater than that of the involute wrap, or channel. It will be appreciated that these parameters are only illustrative and that the combination of such factors as involute material and thickness as well as involute pitch and the thickness of spring element 50 must be considered. These factors are preferably selected such that there results an actuating force on the seal element appropriate for a contact pressure with surface 33 at the desired predetermined working height (tip clearance) of between about 10 psi and about 20 psi. That is, the contact stress at the primary sealing interface is between about 10 psi and about 20 psi.

Because of the involute configuration involved in the axial compliance/sealing means and the fluid pressure differentials in the pockets, there may exist a radial force gradient and hence a radial contact stress gradient in the sealing means. The involute force applying means of this invention provides the opportunity to minimize such gradients to maintain an essentially constant force and constant contact pressure along the entire length of the sealing means. The thickness along the length of the involute force applying means may be increased from the inner to the outer end as shown in FIGS. 5A and 5B; and/or the pitch along the involute length may be made greater from the inner to the outer end as shown in FIG. 5C. These constructional modifications either separately or in combination may be made to achieve the constant force and contact pressure or any other desired force distribution along the involute.

Although there are some pneumatic forces acting upon seal element surface 37 by virtue of the $\Delta P$ existing between pockets 22 and 24, these are not sufficient to effect the preferred sealing at the secondary sealing surface. The desired sealing contact may, however, be readily achieved using the seal element of FIG. 4 by placing it in channel 41 and "screwing" or "torquing" it into the channel to force the element, cut shorter on the inner end and longer on the outer end, into the channel. This results in a circumferential load on the seal element which should be less than that which prohibits free axial motion of the seal element up and down in the channel as brought about by the axial force exerted by the involute spring member and the dynamic motion of the end plate of the opposing scroll member. As an example, it has been found that a preload force of about three pounds falls within the desired range. The combination of the axial and circumferential loading on the seal element in channel 41 provides effective sealing during startup.

Figure 6:
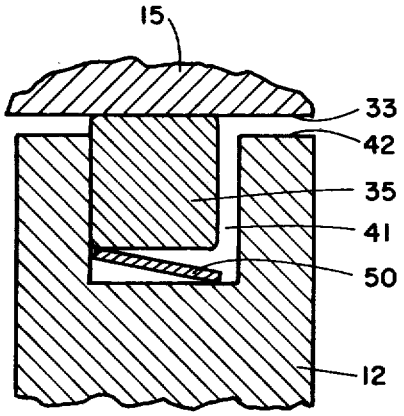
FIGS. 6–8 are partial cross sections of three other embodiment of the axial compliance/sealing means of this invention applied to three-sided channels and illustrating the use of the involute spring member coned in a reverse mode from that of FIG. 3, and the use of a plurality of the involute springs in parallel and in series.
Figure 7:
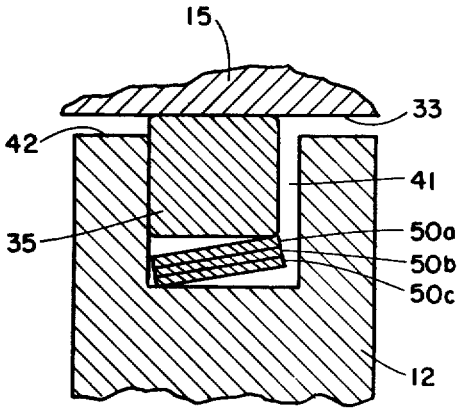
Figure 8:
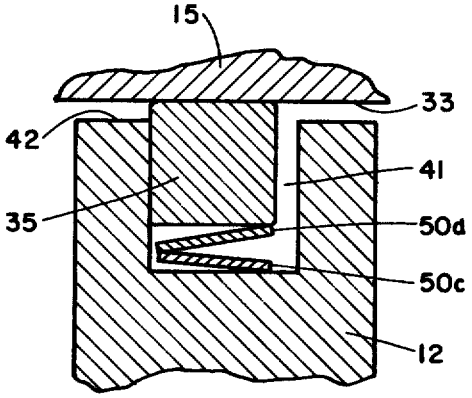
Figure 9:
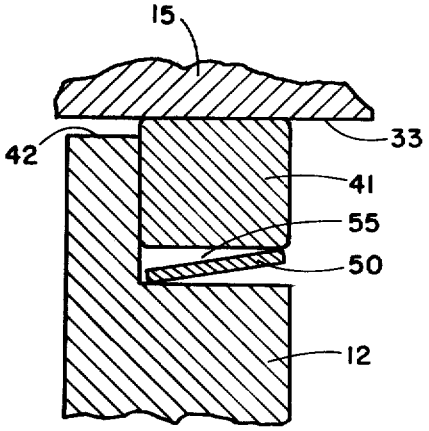
FIG. 9 is a partial cross section of another embodiment of the axial compliance/sealing means using a two-sided channel.

FIG. 6, in which like reference numerals refer to like elements previously described, illustrates the fact that the involute spring member 50 may be coned such that contact with seal element 35 is made through its outer edge rather than the inner edge. FIG. 7 shows that a plurality of involute spring members **50*a*, 50*b* and 50*c* may be used in parallel; and FIG. 8 shows that a plurality of involute spring members 50*d* and 50*e* may be used in series. Finally, FIG. 9 illustrates that the axial compliance/sealing means of this invention may use a two sided channel 55 cut in surface 42 of wraps 12. The various embodiments of seal element 35 and of involute spring member 50 illustrated in FIGS. 3–8 are also applicable to the two-sided channel modification of FIG. 9**.

In illustrating the application of the axial compliance/sealing means of this invention, the scroll apparatus of U.S. Pat. No. 4,065,279 may be taken as exemplary since it is a hermetically sealed compressor designed for extended reliable operation. A longitudinal cross section of such an apparatus is shown in FIG. 10.

In the apparatus illustrated the compressor and motor are completely enclosed within a housing assembly which is generally indicated by the reference numeral 60. The scroll apparatus 61 comprises a fixed or stationary scroll member 62, an orbiting scroll member 63, a thrust bearing assembly 64, a coupling means 65 and a swing-link driving assembly 66.

The stationary scroll member 62 comprises an end plate 67 and spiral wraps 68; and it is rigidly mounted to the bearing assembly 64 through an annular ring 69 by means of a plurality of screws 70 and a pair of pins 71 and 72 in passages 73 and 87, respectively. These pins align the scroll members at final assembly. In FIG. 10, passage 73 is shown off line for convenience of illustration. The orbiting scroll member 63 comprises an end plate 74, involute wraps 75 and a drive shaft 76 integral with end plate 74. End plate 74 of the orbiting scroll serves as the journal of the thrust bearing, and the bottom central surface 77 of end plate 74 is the journal surface contacting the bearing surface 107 of the thrust bearing. A central opening 86 in thrust bearing assembly 64 accommodates the orbiting motion of scroll member 63. Opposing keyways 78 are cut in the bottom surface of the orbiting scroll for engagement with keys on the coupling means as shown in FIGS. 3 and 4 of U.S. Pat. No. 4,065,279.

In the compressor of FIG. 10, sealing between the wraps of the stationary and orbiting scroll members and the end plates they contact is effected through the axial compliance/sealing means of this invention. The flat plate hydrodynamic thrust bearing 64 used in this apparatus is described in detail in U.S. Pat. No. 4,065,279. The coupling member 65 is positioned between the orbiting scroll member and the thrust bearing assembly, thus, in effect, coupling the stationary scroll member to the orbiting scroll member through the thrust bearing and the housing assembly. For such an application as a refrigeration compressor, it is of course necessary that the coupling member also be capable of operating over an extended period of time without experiencing undue wear. Illustrative of a suitable coupling means for this arrangement is the coupling described and claimed in U.S. Pat. No. 4,121,438. As shown in FIG. 10, this coupling member comprises an annular ring 80 which may be formed of a relatively light weight alloy with two keys 81 and 82 oppositely disposed on the bottom side of ring 80 and suitable for slidingly engaging opposing keyways 83 of the thrust bearing, and two keys (not shown) oppositely disposed on the top side of ring 80 and suitable for slidingly engaging keyways 78 on the bottom surface of the end plate of the orbiting scroll member. The keys on one side of the coupling means are spaced 90° from keys on the opposite side. Each of the keys is affixed to ring 80 through a pivot pin 84 and screw 85.

The driving mechanism for the orbiting scroll member includes means to provide a centripetal radial force to oppose a fraction of the centrifugal force acting upon the orbiting scroll member. In accordance with the teaching of U.S. Pat. No. 3,924,977, this driving means used in apparatus illustrated in FIG. 10 incorporates radially compliant mechanical linking means, embodied in a swing-link, to provide the required centripetal forces. Reference should be had to U.S. Pat. No. 3,924,977 for a detailed description of this driving means. As will be seen in FIG. 10, the driving means is affixed to the drive shaft 76 of the orbiting scroll member, the axis of drive shaft 76 being parallel but spaced from the main machine axis of the drive motor by a distance equal to the orbit radius. The swing link comprises a disk member 90, a counterweight 91 integral therewith, an eccentrically positioned bushing 92 for drive shaft 76, and a spring in compression 89 for providing the desired centripetal force. The swing link assembly is affixed to the motor crankshaft assembly 93 though a pivot pin and through a crankshaft stud which is set in a bushing. An 0-ring 88 is used to seal the swing link assembly 66 to the crankshaft assembly 93.

The crankshaft assembly 93, as shown in FIG. 10 is comprised of an eccentrically-configured attachment plate 94 and shaft 95, which is the shaft of motor 96 comprising rotor 97 and stator 98. Within the main housing is motor housing assembly 99 which comprises a vertical section 100 holding bearing 101 for motor shaft 95, a horizontal cover section 102, a smaller annular ring section 103 enclosing plate 94 and a portion of the swing-link assembly and a larger, thick-walled annular ring section 104 providing the surface and base for attaching the scroll assembly through annular ring 69, screws 70 and pins 71 and 72. Motor 96 is affixed to motor housing assembly 99 by means of screw 105 which engages skirt 106 of the motor housing assembly.

Shaft 95 terminates at its bottom end in an oil cup 110 which is immersed in an oil sump 111 contained within the main housing described below. Drilled into shaft 95 are parallel, balancing eccentric oil passages 112 and 113 opening into oil cup 110, passage 112 ending within attachment plate 94 and passage 113 extending the length of the crankshaft and opening into bushing 92 to communicate with bushing oil passage and the basal shaft passage. Passage 112 communicates through radial passage 114 which in turn communicates with the interior volume 115 of the motor housing assembly 99 though clearance 116. Passage 114 also communicates with a series of clearance passages 117, 118 and 119 to provide lubrication along the length of bearing 101. By virtue of the other clearances shown within the motor housing assembly, oil pumped up through passages 112, 113 and 114 by rotating cup 110 is forced as a lubricant into the orthogonal grooving in the bearing surface 123 of the hydrodynamic thrust heading, through grooves of the keys attached to the coupling member, between shafts 76 and 95 and their respective bushings and between the seal elements and their contacting end plate. Circulation of the lubricating oil in this manner also serves to cool the various apparatus components. The lubricating oil is returned to sump 111 through apertures in the motor housing assembly such as aperture 120, and through fluid manifold 121 and narrow clearance 122 defined between motor stator 98 and the internal wall of the main housing.

Motor shaft 95 also has a short axial passage 125 for proper venting of the oil pumping element 110, and shaft 95 has attached to it at its lower end a counterweight 126 which serves to counterbalance the swing-link attached to the crankshaft and to minimize vibration.

The main housing 60 is made up of a base plate 130 adapted for attachment to a support (not shown), a lower housing section 131 with a flared upper portion 132, an upper housing section 133 and a cover member 134. Lower housing section 131 has flange 135 welded to its upper flared portion 132, while upper housing section 133 has mating flange 136 welded to it. These flanges 135 and 136 provide the means for joining lower and upper sections 131 and 133 through a plurality of screws 137 using an 0-ring seal 138 in a manner to support and affix the thrust bearing assembly to the housing.

The low pressure fluid to be compressed is introduced into peripheral scroll pockets 140 through an inlet line 141 which leads into fluid manifold 121 defined within the flared upper portion 132 of the housing. As detailed in U.S. Pat. No. 4,065,279, there are provided cutouts in the thrust bearing assembly and cutouts aligned therewith in annular ring 69 which provide low-pressure fluid passages and hence fluid communications between peripheral scroll pockets 140 and fluid manifold 121. Inlet line 141 (of which there may be more than one) has a slip-on flange 142, with seal groove 143 and bolt holes 144 for connecting inlet line 141 to a source of low-pressure fluid for compression.

As previously noted, compression is accomplished in the scroll apparatus by forcing fluid introduced into the peripheral inlet pockets into fluid pockets, defined by the wraps, which become smaller in volume as the fluid is forced into the central or high-pressure fluid pocket 150 through pockets 151 and 152. Thus in the compressor of FIG. 10, high-pressure fluid is discharged from central pocket 152 through a central outlet tube 153 which is set in end plate 67 of the stationary scroll member and extends through cover member 134 of the main housing. A fluid passage 154 is cut through end plate 67 to provide fluid communication between central pocket 150 and outlet tube 153; and 0-rings 155 and 156 are used to seal outlet tube 153 to end plate 62 and housing cover 134. A high-pressure discharge line 157, with an attached slip-on flange 158, having a seal channel 159 and bolt holes 160, provides the means to connect outlet tube 157 with suitable high-pressure conduit means, not shown.

It will be appreciated that the compressor illustrated in FIG. 10 is but one example of scroll apparatus which may incorporate the axial compliance/sealing means of this invention. These sealing means are, of course, applicable to any other scroll apparatus whether it is a compressor, expander or pump.

From the above detailed description of the sealing means of this invention, and of scroll apparatus incorporating them, it will be seen that they provide effective radial sealing through the use of mechanical force applying means which are easy and inexpensive to make and to install. These force applying involute spring members are capable of effective operation over extended time periods in a wide range of environments and they offer a range of operating characteristics including the maintaining of essentially constant force and constant contact pressure along the primary sealing interface between the seal element and the end plate surface of a complementary scroll member. The preferred seal element modification also makes possible the attainment of effective sealing of the secondary sealing interface between the seal element and the channel wall. This combined sealing action is available during apparatus startup.

It will thus be seen that the objects set forth above, among those made apparent from the preceding discription, are efficiently attained, since certain changes may be made in the above constructions without departing from the scope of the invention, it is intended that all matter contained in the above description or shown in the accompanying drawings shall be interpreted as illustrative and not in a limiting sense.

I claim:

1. A method of making an axially biasing spring element for a tip seal element in an involute scroll fluid moving apparatus, including a scroll member having an involute curved channel including a bottom wall and at least one side wall extending along the axial end of the scroll member, said tip seal element being of involute configuration and normally disposed at least partially in said channel above said bottom wall for axial movement therein, comprising the steps of:

(a) forming an involute curved sheet metal spring element from spring metal so that the thickness of the sheet metal element all lies in substantially the same plane in its relaxed state, with the pitch of the involute curve of the spring element being greater than that of the channel, the width of the spring element being substantially greater than its thickness and less than the width of the channel;

(b) deforming the spring element by bending it in its own plane so that the pitch of its involute curve matches that of the channel, the deformation not exceeding the elastic limit of the sheet metal material and causing said spring element to assume a coned angle along its length; and (c) placing the deformed spring element in the channel adjacent the bottom wall of the channel.

2. The method as claimed in claim 1, including forming said spring element so that the pitch of its involute curve is greater towards the outer end area of its involute curve than at the inner end area of its involute curve.

3. The method as claimed in claim 1, including forming said spring element so that the pitch of the involute curve of the spring element is from 10 to 20 percent greater than the pitch of the involute curve of the channel.

4. The method as claimed in claim 1, including forming said metal spring element initially by blanking same out of sheet or flat plate spring metal material in its involute curved relaxed state.

5. A method as claimed in claim 1, including forming said spring element so that its thickness at the inner end area of its involute curve is greater than its thickness at its outer end area of its involute curve.

6. A method as claimed in claim 5, including forming said spring element so that the pitch of its involute curve is greater towards the outer end area of its involute curve than at the inner end area of its involute curve.

7. A method of making a tip seal in an involute scroll fluid apparatus including a scroll member having an involute curved channel including a bottom wall and at least one side wall extending along the axial end of the scroll member, and a tip seal element normally disposed at least in part in said channel above said bottom wall for axial movement therein, comprising the steps of:

(a) forming the tip seal element so that it has an involute curved configuration substantially matching that of the channel;

(b) forming the length of the tip seal element so that it is shorter at its inner end than said channel and longer at its outer end than said channel; and (c) placing the seal element in the channel in its normal, relaxed condition and subsequently torqueing it within the channel to force the inner and outer ends into the channel and to therefore provide a circumferential load on the seal element against a side wall of the channel.

8. A method of making a tip seal assembly in an involute scroll fluid apparatus including a scroll member having an involute curved channel including a bottom wall and at least one side wall, the channel extending along the axial end of the scroll member, comprising the steps of:

(a) forming a tip seal element so that it has an involute curvature corresponding to the involute curvature of said channel, the width of the tip seal element being less than the width of the channel to enable the tip seal element to freely move axially within the channel, and also forming the tip seal element so that it is shorter at its inner end than the inner end of the channel and longer at its outer end than the outer end of the channel;

(b) forming an involute curved sheet metal spring element from spring metal so that the thickness of the sheet metal all lies in substantially the same plane in its relaxed state, with the pitch of the involute curve of the spring element being greater than that of the channel, and with the width of the spring element being substantially greater than the thickness thereof but less than the width of the channel;

(c) deforming the spring element by bending it in its own plane so that the pitch of its involute curve matches that of the channel, the deformation not exceeding the elastic limit of the spring element but causing it to assume a coned angle along its length;

(d) placing said spring element adjacent the bottom wall of said channel; and (e) placing said tip seal element in the channel above the spring element with the seal element deformed to match the involute curve of the channel over the full length of the seal to produce a circumferential load on the seal element against a side wall of the channel, the tip seal normally resting against the spring element with a portion of the tip seal extending axially outwardly of the channel.

9. In an involute scroll member having an involute curved tip seal disposed in an involute curved channel extending along the length of the axial end of the scroll member, the tip seal being freely movable axially within the channel, which has a bottom wall and at least one side wall, and means for axially biasing the tip seal in a direction axially away from the bottom wall of the channel, the improvement comprising:

said means for axially biasing the tip seal comprising an involute spring member formed of thin, flexible sheet spring metal material that has a cross sectional width substantially greater than its thickness, the sheet metal material lying substantially in a single plane and extending along an involute curve having a pitch greater than the involute curve of said channel when said spring member is in its relaxed state, the cross sectional width of the sheet material being less than the width of the channel; said involute spring member being disposed in said channel in a deformed, coned state between said seal and the bottom wall of the channel, said deformed, coned state not exceeding the elastic limit of the sheet material, and existing solely as a result of the deformation of the larger pitch involute spring to conform with the smaller pitch channel.

10. The improvement in an involute scroll member as claimed in claim 9, said tip seal being shorter at its inner end than said channel and extending beyond the channel at its outer end in its unassembled and relaxed condition, whereby upon torqueing of said seal into the channel the seal is circumferentially preloaded against a side wall of the channel.

11. The improvement in an involute scroll member is claimed in claim 9, said involute spring member having inner and outer end areas, said inner end area having an involute pitch that is greater than said outer end area.

12. The improvement in an involute scroll member as claimed in claim 9, said involute spring member having inner and outer end areas, said inner end area being thinner in thickness than said outer end area.

13. The improvement in an involute scroll member as claimed in claim 12, said involute spring member having inner and outer end areas, said outer end area having an involute pitch that is greater than said inner end area.

* * * * *